US010104920B1

(12) United States Patent
Robinson

(10) Patent No.: US 10,104,920 B1
(45) Date of Patent: Oct. 23, 2018

(54) PANTS OR SKIRT WITH INTEGRAL EXERCISE BANDS

(71) Applicant: Barbara Robinson, Seattle, WA (US)

(72) Inventor: Barbara Robinson, Seattle, WA (US)

( * ) Notice: Subject to any disclaimer, the term of this patent is extended or adjusted under 35 U.S.C. 154(b) by 113 days.

(21) Appl. No.: 15/208,086

(22) Filed: Jul. 12, 2016

(51) Int. Cl.
*A41D 1/14* (2006.01)
*A41D 13/00* (2006.01)
*A41D 1/08* (2018.01)
*A41D 31/00* (2006.01)

(52) U.S. Cl.
CPC ..... *A41D 13/0015* (2013.01); *A41D 1/08* (2013.01); *A41D 1/14* (2013.01); *A41D 31/00* (2013.01)

(58) Field of Classification Search
CPC ..... A41D 13/0015; A41D 1/08; A41D 1/14; A41D 31/00
USPC ... 2/211, 212, 220, 221, 227, 228, 236, 237, 2/69
See application file for complete search history.

(56) References Cited

U.S. PATENT DOCUMENTS 2,997,044 A * 8/1961 Simons ..... A41B 9/02 2/401
3,465,757 A * 9/1969 Barg ..... A41C 1/003 2/240
3,678,514 A * 7/1972 Safrit ..... A41B 9/08 2/212
5,357,637 A 10/1994 Moore
6,035,448 A * 3/2000 Thomson ..... A41D 1/06 2/227
6,430,752 B1 8/2002 Bay
6,645,128 B1 11/2003 Hur
8,276,216 B2 10/2012 Carney
D687,214 S 8/2013 Farina
8,951,136 B1 2/2015 Booher
2009/0083894 A1* 4/2009 Causey-Gabbe ..... A41B 9/08 2/78.1
2011/0179555 A1* 7/2011 Bickley ..... A41D 1/08 2/401
2011/0314590 A1 12/2011 Perron
2013/0225046 A1* 8/2013 Kitagawa ..... A41C 1/003 450/100
2015/0320121 A1* 11/2015 Fligel ..... A41C 1/10 450/155

FOREIGN PATENT DOCUMENTS

WO 2010102378 A1 9/2010

* cited by examiner

*Primary Examiner* — Gloria Hale
(74) *Attorney, Agent, or Firm* — Kyle A. Fletcher, Esq.

(57) ABSTRACT

The pants or skirt with integral exercise bands is adapted for use in exercise. The pants or skirt with integral exercise bands comprises a garment and a pelvic girdle. The pelvic girdle is attaches to the garment. The pants or skirt with integral exercise bands is a pelvic girdle adapted for use in a garment selected from the group consisting of a pair of pants or a skirt. The pelvic girdle is an elastic fabric that is formed in the shape of a tube. The pelvic girdle is positioned within the garment such that when the garment is worn normally, the normal locomotive motions of the wearer are resisted by the pelvic girdle therein enhancing the exercise benefit generally provided by the normal locomotive motion. Normal locomotive motions include, but are not limited to, walking forward, walking backward, stepping sideways, bending over, and stooping.

11 Claims, 7 Drawing Sheets

PANTS OR SKIRT WITH INTEGRAL EXERCISE BANDS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of exercise apparatus for sports, games, and amusements, more specifically, an apparatus for attaching a resistance based exercise device to the lower limbs and buttocks of a person.

SUMMARY OF INVENTION

The pants or skirt with integral exercise bands is adapted for use in exercise. The pants or skirt with integral exercise bands comprises a garment and a pelvic girdle. The pelvic girdle is attaches to the garment. The pants or skirt with integral exercise bands is a pelvic girdle adapted for use in a garment selected from the group consisting of a pair of pants or a skirt. The pelvic girdle is an elastic fabric that is formed in the shape of a tube. The pelvic girdle is positioned within the garment such that when the garment is worn normally, the normal locomotive motions of the wearer are resisted by the pelvic girdle therein enhancing the exercise benefit generally provided by the normal locomotive motion. Normal locomotive motions include, but are not limited to, walking forward, walking backward, stepping sideways, bending over, and stooping.

These together with additional objects, features and advantages of the pants or skirt with integral exercise bands will be readily apparent to those of ordinary skill in the art upon reading the following detailed description of the presently preferred, but nonetheless illustrative, embodiments when taken in conjunction with the accompanying drawings.

In this respect, before explaining the current embodiments of the pants or skirt with integral exercise bands in detail, it is to be understood that the pants or skirt with integral exercise bands is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the pants or skirt with integral exercise bands.

It is therefore important that the claims be regarded as including such equivalent construction insofar as they do not depart from the spirit and scope of the pants or skirt with integral exercise bands. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
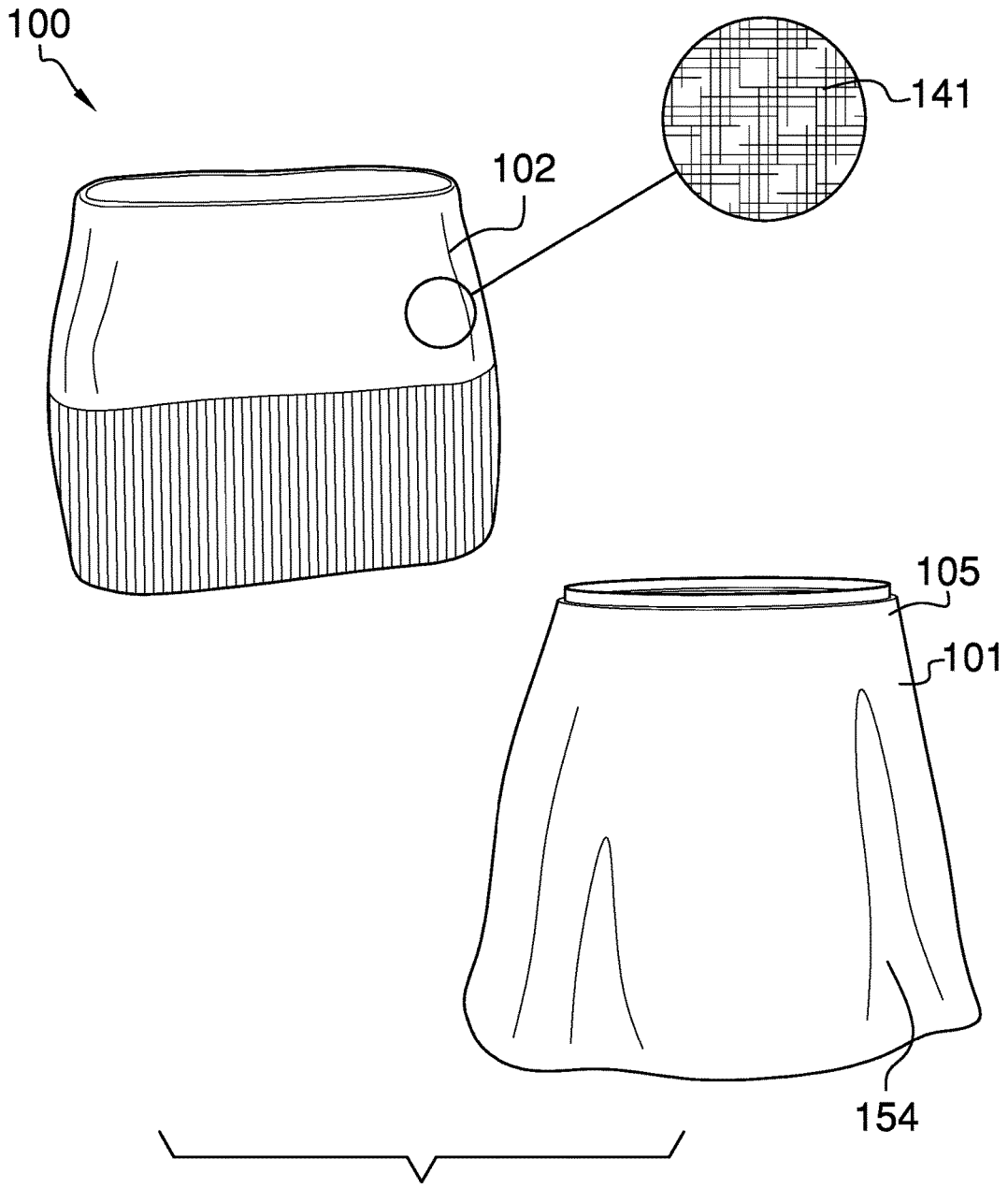
FIG. 1 is an exploded view of an embodiment of the disclosure.
Figure 2:
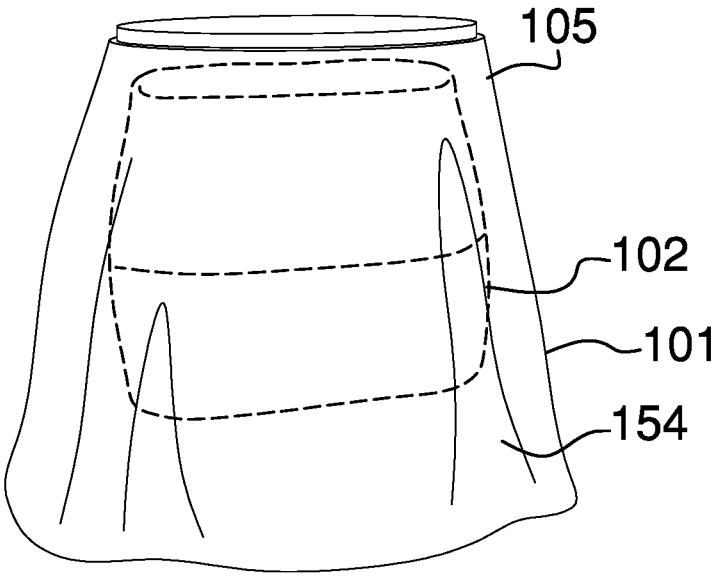
FIG. 2 is an assembled view of an embodiment of the disclosure.
Figure 3:
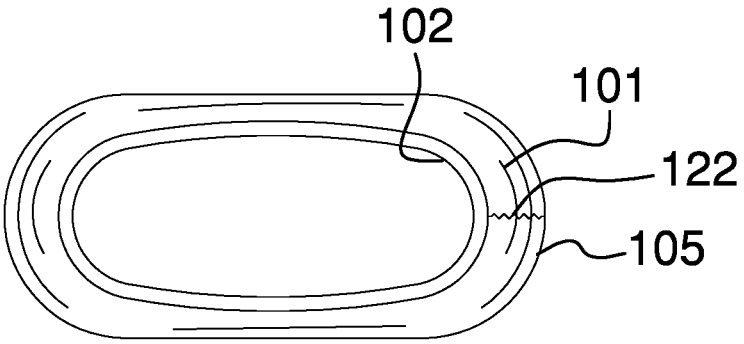
FIG. 3 is a top view of an embodiment of the disclosure.
Figure 4:
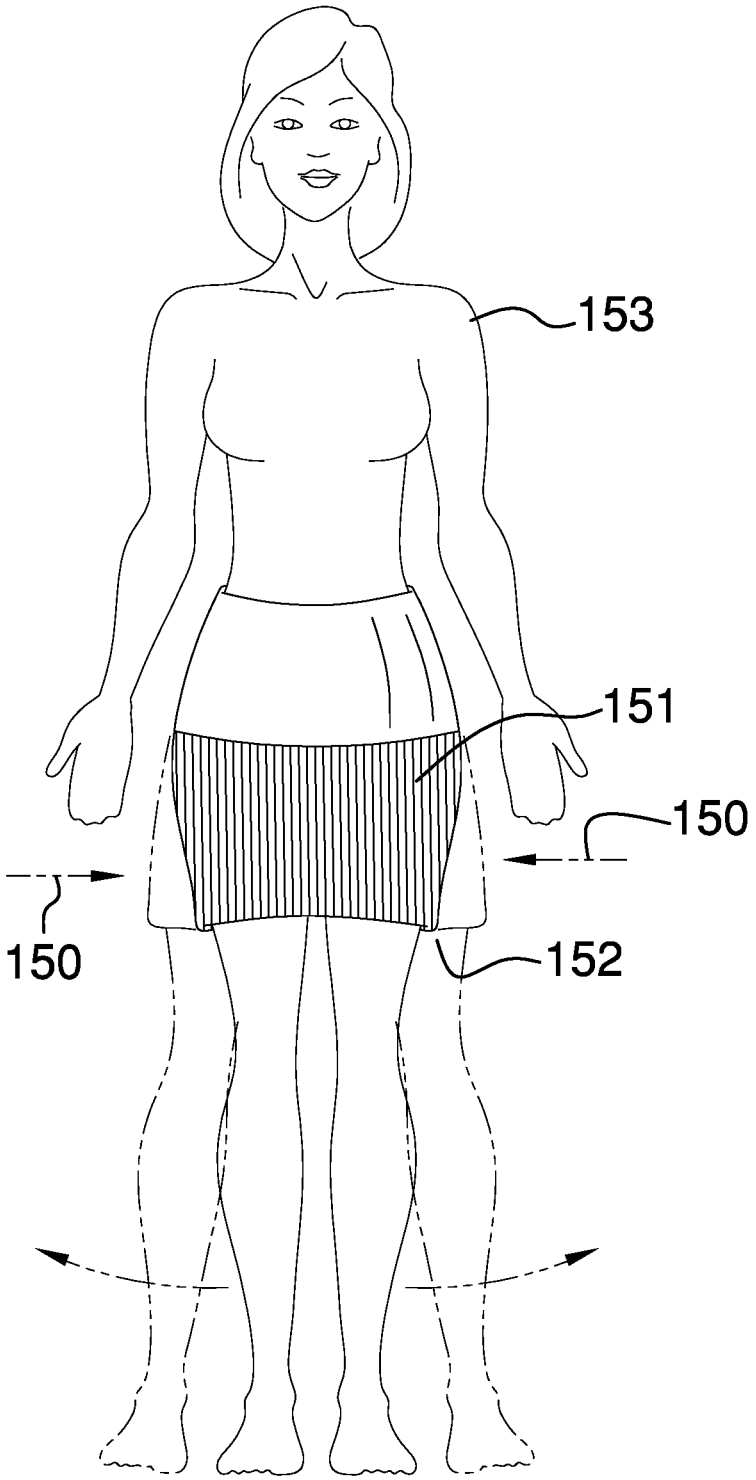
FIG. 4 is an in use view of an embodiment of the disclosure.
Figure 5:
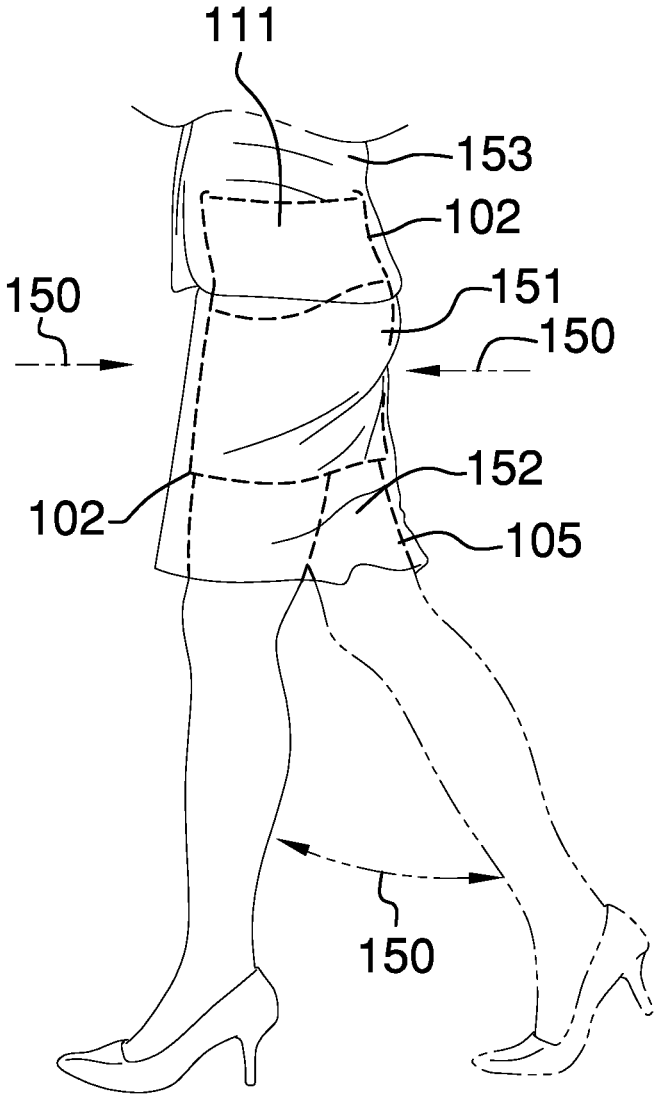
FIG. 5 is an in use view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 8.

The pants or skirt with integral exercise bands 100 (hereinafter invention) comprises a garment 101 and a pelvic girdle 102. The invention 100 is adapted for use in exercise. The pelvic girdle 102 attaches to the garment 101. The invention 100 is a pelvic girdle 102 adapted for use in a garment 101 selected from the group consisting of a pair of pants 106 or a skirt 105. The pelvic girdle 102 is an elastic fabric that is formed in the shape of a tube. The pelvic girdle 102 is positioned within the garment 101 such that when the garment 101 is worn normally, the normal locomotive motion 150 of the wearer 153 is resisted by the pelvic girdle 102 therein enhancing the exercise benefit generally provided by the normal locomotive motion 150. Normal locomotive motion 150 includes, but is not limited to, walking forward, walking backward, stepping sideways, bending over, and stooping.

The pelvic girdle 102 is base fabric 111 that is selected from the group consisting of an elastic textile or an elastic sheeting. As shown most clearly in FIGS. 5, 6, and 7, the pelvic girdle 102 is attached to the garment 101 such that the pelvic girdle 102 will encompass the pelvis 151 and the upper thighs 152 of the wearer 153. The base fabric 111 is a rectangular structure that is further defined with a thirteenth edge 173 and a fourteenth edge 174. When the base fabric 111 is formed as a textile, the pelvic girdle 102 gets its elastic nature from elastic yarns 141 that are incorporated into the weaving or knitting pattern used to form the elastic textile that forms the base fabric 111. When the base fabric 111 is formed from a sheeting, an elastic material is used to form the sheeting. The force required to stretch the base fabric 111, as defined by the modulus of the base fabric 111, provides the resistance to normal locomotive motion 150 that enhances the exercise benefit of the normal locomotive motion 150. Methods to form base fabrics 111 incorporating elastic yarns 141 are well known and documented in the textile arts. Methods to form elastic sheeting are well known in the textile arts. Elastic textiles and elastic sheetings are readily and commercially available. Methods to modify modulus within elastic textiles and elastic sheetings are well known and documented in the textile arts.

Figure 6:
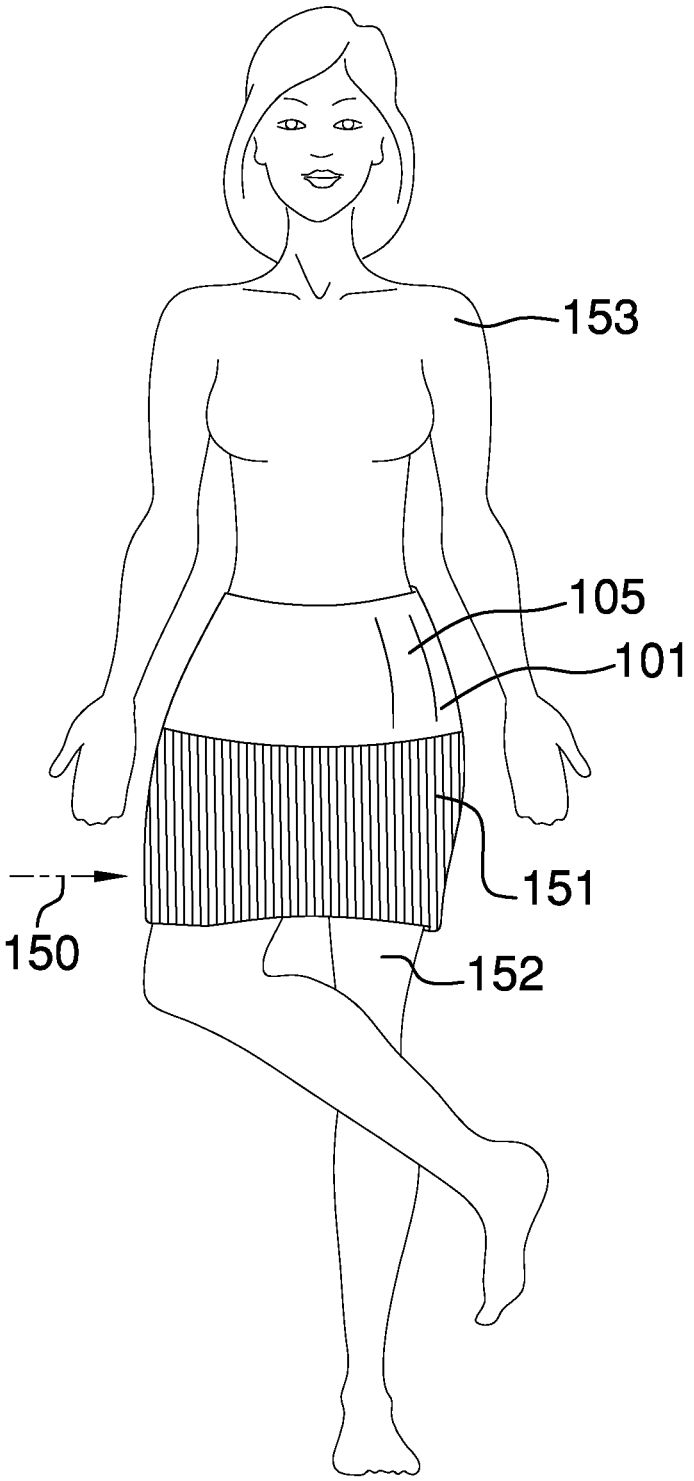
FIG. 6 is an in use view of an embodiment of the disclosure.
Figure 7:
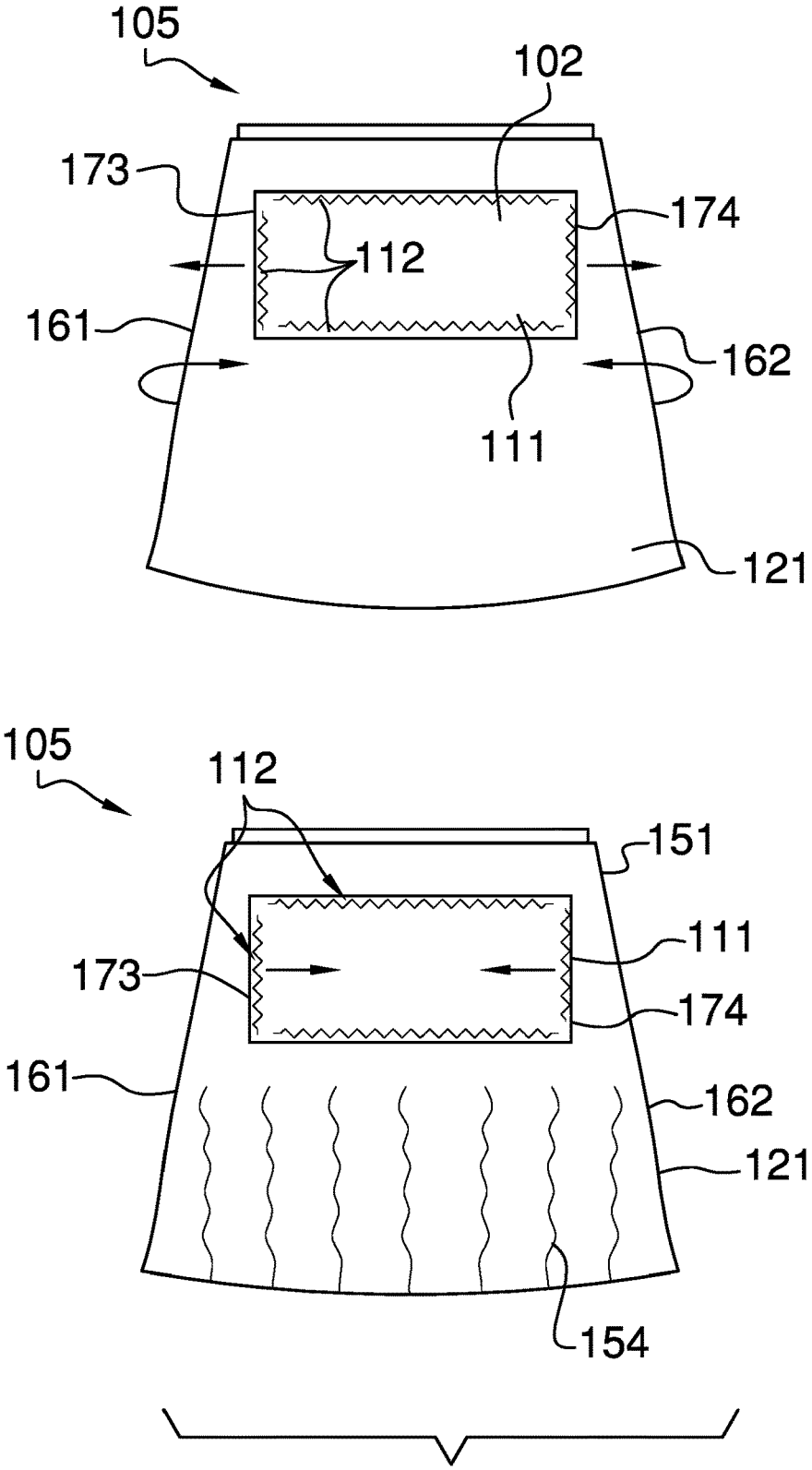
FIG. 7 is a detail view of an embodiment of the disclosure.

As shown in FIGS. 6 and 7, the base fabric 111 is attached to the garment 101 using a plurality of girdle seams 112. Potential methods to form plurality of girdle seams 112 include, but are not limited to, sewn seams, heat bonding, or ultrasonic bonding. The use of sewn seams is preferred. The base fabric 111 is joined to the garment 101 such that the base fabric 111 is not visible when the garment 101 is worn properly. The base fabric 111 is positioned within the garment 101 such that the base fabric 111 will cover the pelvis 151 and upper thighs 152 of the wearer 153. The base fabric 111 is joined to the garment 101 by placing the base fabric 111 under tension. While the base fabric 111 is under tension, the base fabric 111 is attached to the garment 101 using the plurality of girdle seams 112. When the tension on the garment 101 is released and the base fabric 111 returns to a relaxed shape. The return to the relaxed shape of the base fabric 111, as shown in FIG. 7B, will cause some garments 101 to drape 154.

In the first potential embodiment of the disclosure, as shown most clearly in FIG. 7, when the selected garment 101 is a skirt 105, the skirt 105 is formed from a trapezoidal fabric 121. It is preferred that a textile forms the trapezoidal fabric 121. The trapezoidal fabric 121 is further defined with a first edge 161 and a second edge 162. The pelvic girdle 102 is installed directly on the trapezoidal fabric 121 as described elsewhere in this disclosure. Once the pelvic girdle 102 is attached, the skirt 105 is finished by joining the first edge 161 to the second edge 162 with a first garment seam 122 such that the thirteenth edge 173 and the fourteenth edge 174 are also joined together. Methods to form skirts 105 are well known and documented in the textile arts.

Figure 8:
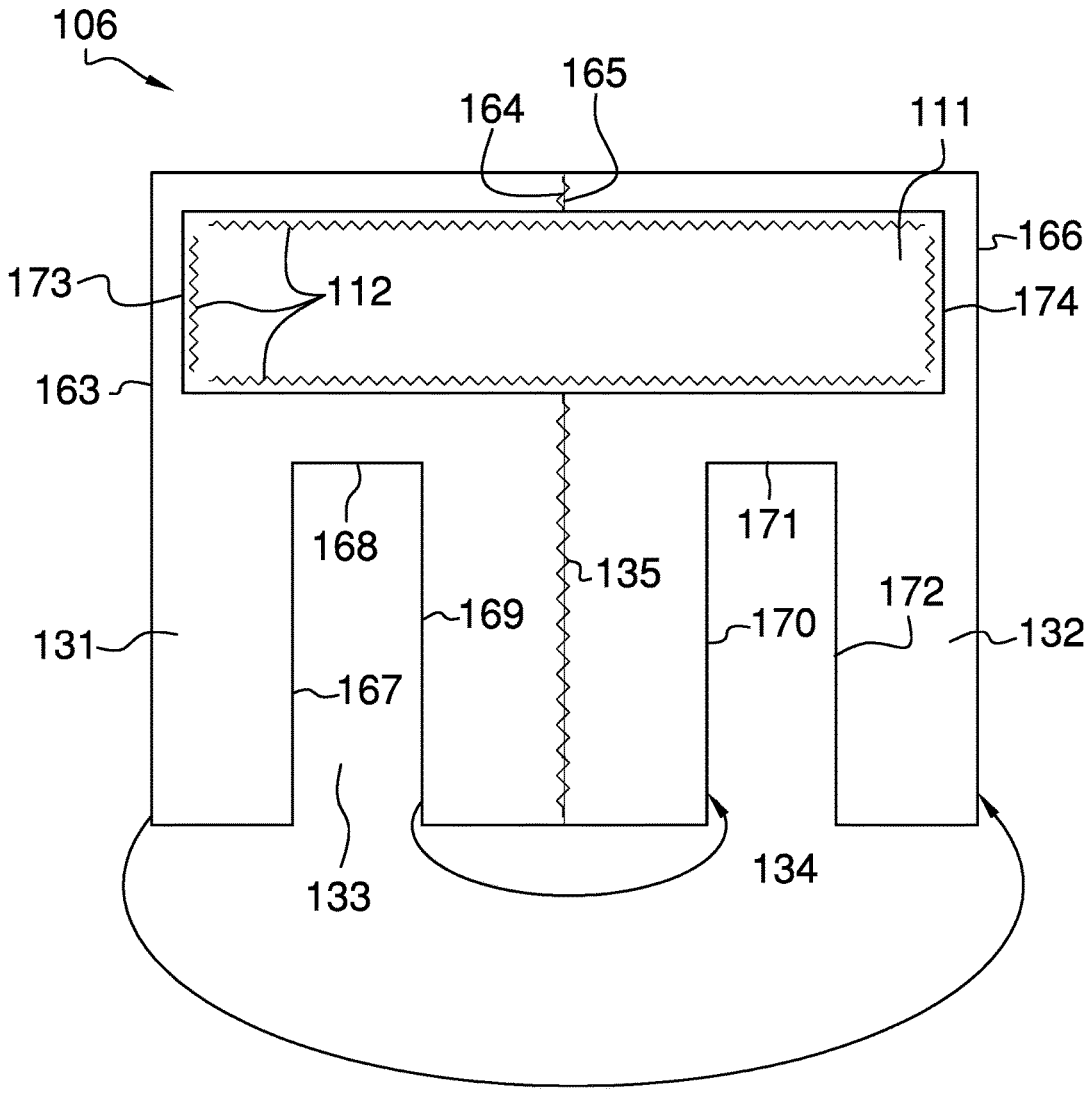
FIG. 8 is a detail view of an embodiment of the disclosure.

In the second potential embodiment of the disclosure, as shown clearly in FIG. 8 when the selected garment 101 is a pair of pants 106, the pair of pants 106 are formed from a first panel 131 and a second panel 132. The first panel 131 is a first rectangular fabric. It is preferred that a textile forms the first panel 131. The first panel 131 has formed in it a first rectangular negative space 133 that is used to form the legs of the pair of pants 106. The first panel 131 is further defined with at third edge 163 and a fourth edge 164. The first rectangular negative space 133 is bounded by a seventh edge 167, an eighth edge 168 and a ninth edge 169.

The second panel 132 is a second rectangular fabric. It is preferred that a textile forms the second panel 132. The second panel 132 has formed in it a second rectangular negative space 134 that is used to form the legs of the pair of pants 106. The second panel 132 is further defined with at fifth edge 165 and a sixth edge 166. The second rectangular negative space 134 is bounded by a tenth edge 170, an eleventh edge 171 and a twelfth edge 172.

To prepare the pair of pants 106 to receive the pelvic girdle 102, the fourth edge 164 is joined to the fifth edge 165 using a second garment seam 135. The pelvic girdle 102 is installed directly on the joined first panel 131 and second panel 132 as described elsewhere in this disclosure. The pelvic girdle 102 is positioned such that the pelvic girdle overlays the second garment seam 135. Once the pelvic girdle 102 is attached, the pair of pants 106 are finished by: 1) joining the seventh edge 167 to the twelfth edge 172; 1) joining the eighth edge 168 to the eleventh edge 171; 3) joining the ninth edge 169 to the tenth edge 170; and 4) joining the third edge 163 to the sixth edge 166 such that the thirteenth edge 173 and the fourteenth edge 174 are also joined together. Methods to form pants 106 are well known and documented in the textile arts.

To use the invention 100, the garment 101 is worn as a normal garment 101 and the wearer 153 moves normally within the garment 101.

The following definitions were used in this disclosure:

Drape: As used in this disclosure, to drape means to arrange in a fabric in flowing lines and folds.

Elastic: As used in this disclosure, an elastic is a material or object that deforms when a force is applied to it and that is able to return to its original shape after the force is removed. A material that exhibits these qualities is also referred to as an elastomeric material.

Elastic Textile: As used in this disclosure, an elastic textile is a textile that contains elastic yarns as some of the yarns that make up the textile. An elastic textile is constructed such that the elastic textile will stretch when a force is applied and will return to its original shape when after the force is removed.

Elastic Yarn: As used in this disclosure, an elastic yarn is a yarn formed from elastomeric materials.

Modulus: As used in this disclosure, the modulus of an elastic textile or elastic sheeting is a function that describes the percentage change in the span of the elastic textile or elastic sheeting as a function of the force applied to the elastic textile or elastic sheeting. When comparing modulus, a larger modulus is taken to imply that an increase in force is required to get the same percentage change in the elastic textile or elastic sheeting.

Negative Space: As used in this disclosure, negative space is a method of defining an object through the use of open or empty space as the definition of the object itself, or, through the use of open or empty space to describe the boundaries of an object.

Perimeter: As used in this disclosure, a perimeter is one or more curved or straight lines that bounds an enclosed area on a plane or surface. The perimeter of a circle is commonly referred to as a circumference.

Relaxed Shape: As used in this disclosure, a structure is considered to be in its relaxed state when no shear, strain, or torsional forces are being applied to the structure.

Seam: As used in this disclosure, a seam is a joining of: 1) a first textile to a second textile; 2) a first sheeting to a second sheeting; or, 3) a first textile to a first sheeting.

Pelvis: As used in this disclosure, the pelvis refers to a bone structure near the base of the spine to which buttocks and the legs are joined. As used in this disclosure, the term pelvis is a more generally expanded to describe the above described region of the body. As used in this disclosure, the adjectival form of pelvis is pelvic.

Sewn Seam: As used in this disclosure, a sewn seam a method of attaching two or more layers of textile, leather, or other material through the use of a thread, a yarn, or a cord that is repeatedly inserted and looped through the two or more layers of textile, leather, or other material.

Sheeting: As used in this disclosure, sheeting is a material, such as cloth or plastic, in the form of a thin flexible layer or layers.

Textile: As used in this disclosure, a textile is a material that is woven, knitted, braided or felted. Synonyms in common usage for this definition include fabric and cloth.

Trapezoid: As used in this disclosure, a trapezoid is a quadrilateral with one pair of parallel sides. An isosceles trapezoid is a trapezoid for which a line exists that: 1) intersects opposite sides of the trapezoid; and, 2) bisects the trapezoid into two congruent shapes or structures.

Yarn: As used in this disclosure, a yarn is continuous strand of textile fibers and filaments. Yarns are generally used in the production of fabrics. For the purposes of this disclosure, this definition explicitly includes yarns formed from a single filament such as a monofilament yarn.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An exercise device comprising:
a garment and a pelvic girdle;
said exercise device is adapted for use during exercise by a wearer;
wherein the garment is selected from the group consisting of a pair of pants or a skirt;
the pelvic girdle is formed of a base elastic fabric that is formed in a shape of a tube, and is adapted to provide resistance to conventional motion of said wearer when worn;
wherein the base fabric is selected from the group consisting of an elastic textile or an elastic sheeting;
wherein the pelvic girdle is attached to the garment such that the pelvic girdle is adapted to encompass a pelvis and upper thighs of the wearer;
wherein the base fabric is a rectangular structure that is further defined with a first edge and a second edge;
the pelvic girdle base fabric is attached to the garment using a plurality of girdle seams from the group consisting of sewn seams, heat bonded seams, or ultrasonically bonded seams so that the seam joint is not visible from the exterior of the garment when worn;
wherein the pelvic girdle base fabric is attached to the garment while under tension to thereby provide said resistance when the wearer is in motion.

2. The exercise device according to claim 1
wherein the garment is a skirt that
is formed from a trapezoidally shaped fabric.

3. The exercise device according to claim 2
wherein the trapezoidally shaped fabric is further defined with a third edge and a fourth edge;
wherein the pelvic girdle is installed directly on the trapezoidally shaped fabric;
wherein the third edge is joined to the fourth edge with a first garment seam such that the first edge and the second edge are joined.

4. The exercise device according to claim 1
wherein the garment is a pair of pants;
wherein the pair of pants comprises a first panel and a second panel;
wherein the first panel is a first rectangular fabric;
wherein the first panel has formed in it a first rectangular negative space;
wherein the second panel is a second rectangular fabric;
wherein the second panel has formed in it a second rectangular negative space;
wherein the first panel and the second panel form the legs of the pair of pants with the first rectangular negative space and the second rectangular negative space being the are between the legs of the pair of pants.

5. The exercise device according to claim 4
wherein the first panel is further defined with a fifth edge and a sixth edge;
wherein the first rectangular negative space is bounded by a ninth edge, a tenth edge and an eleventh edge;
wherein the second panel is further defined with a seventh edge and an eighth edge;
wherein the second rectangular negative space is bounded by a twelfth edge, a thirteenth edge and a fourteenth edge;
wherein the sixth edge is joined to the seventh edge using a second garment seam;
wherein the pelvic girdle attaches to both the first panel and second panel such that the pelvic girdle overlays the second garment seam.

6. The exercise device according to claim 5
wherein the fifth edge joins the eighth edge;
wherein the ninth edge joins the fourteenth edge;
wherein the tenth edge joins the thirteenth edge;
wherein the eleventh edge joins the twelfth edge.

7. The exercise device according to claim 6 wherein each of the plurality of girdle seams are sewn seams.

8. The exercise device according to claim 1
wherein the base fabric is an elastic sheeting;
wherein the base fabric is formed with an elastic material.

9. The exercise device according to claim 8
wherein the garment is a skirt;
wherein the skirt is formed from a trapezoidally shaped fabric;
wherein the trapezoidally shaped fabric is further defined with a third edge and a fourth edge;
wherein the pelvic girdle is installed directly on the trapezoidally shaped fabric to form a single layer;
wherein the third edge is joined to the fourth edge with a first garment seam such that the first edge and the second edge are joined.

10. The exercise device according to claim 9 wherein each of the plurality of girdle seams are sewn seams.

11. The exercise device according to claim 8
wherein the garment is a pair of pants;
wherein the pair of pants comprises a first panel and a second panel;
wherein the first panel is a first rectangular fabric;
wherein the first panel has formed in it a first rectangular negative space;

wherein the second panel is a second rectangular fabric;

wherein the second panel has formed in it a second rectangular negative space;

wherein the first panel and the second panel form the legs of the pair of pants with the first rectangular negative space and the second rectangular negative space being the are between the legs of the pair of pants;

wherein the first panel is further defined with a fifth edge and a sixth edge;

wherein the second panel is further defined with a seventh edge and an eighth edge;

wherein the sixth edge is joined to the seventh edge using a second garment seam;

wherein the pelvic girdle attaches to both the first panel and second panel such that the pelvic girdle overlays the second garment seam;

wherein the fifth edge joins the eighth edge such that the first edge and the second edge are joined together;

wherein each of the plurality of girdle seams are sewn seams.

* * * * *